US008277036B2

(12) United States Patent
Takata

(10) Patent No.: US 8,277,036 B2
(45) Date of Patent: Oct. 2, 2012

(54) LIQUID DISCHARGING APPARATUS

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 655 days.

(21) Appl. No.: 12/243,812

(22) Filed: Oct. 1, 2008

(65) Prior Publication Data

US 2009/0085994 A1 Apr. 2, 2009

(30) Foreign Application Priority Data

Oct. 1, 2007 (JP) ..... 2007-257994

(51) Int. Cl.
*B41J 2/175* (2006.01)

(52) U.S. Cl. ..... 347/94; 347/85; 347/86

(58) Field of Classification Search ..... None
See application file for complete search history.

(56) References Cited

U.S. PATENT DOCUMENTS

| | | | |
|---|---|---|---|
| 5,270,739 | A | 12/1993 | Kitani et al. |
| 5,500,664 | A | 3/1996 | Suzuki et al. |
| 5,777,649 | A | 7/1998 | Otsuka et al. |
| 6,241,350 | B1 | 6/2001 | Otsuka et al. |
| 6,290,345 | B1 | 9/2001 | Sasaki et al. |
| 2004/0233259 | A1 | 11/2004 | Amma et al. |
| 2005/0151809 | A1 | 7/2005 | Corner et al. |
| 2005/0206691 | A1 | 9/2005 | Takata et al. |
| 2006/0038862 | A1 * | 2/2006 | Tanno ..... 347/84 |

FOREIGN PATENT DOCUMENTS

| | | | |
|---|---|---|---|
| EP | 1525986 | A2 | 4/2005 |
| EP | 1577096 | A1 | 9/2005 |
| EP | 1586453 | A2 | 10/2005 |
| JP | H04-151258 | A | 5/1992 |
| JP | H04-288240 | A | 10/1992 |
| JP | H06-210872 | A | 8/1994 |
| JP | H07-164638 | A | 6/1995 |
| JP | H08-025652 | A | 1/1996 |
| JP | H09-286117 | A | 11/1997 |

(Continued)

OTHER PUBLICATIONS

European Patent Office, Extended European Search Report for European Patent Application No. 080172372, dated Mar. 6, 2009. (Counterpart to above-captioned U.S. patent application.)

*Primary Examiner* — Matthew Luu
*Assistant Examiner* — Erica Lin
(74) *Attorney, Agent, or Firm* — Baker Botts L.L.P.

(57) ABSTRACT

The image forming apparatus includes a liquid discharging head that discharges a liquid; and a damper chamber that is provided in a liquid supply flow channel, the damper chamber being an internal space that is formed by bonding a flexible member to a base member, wherein the flexible member has a bonding surface that is bonded to the base member, an opening that is formed in the bonding surface, and a swollen portion that is three-dimensionally swollen from the edge of the opening to form the damper chamber, the base member has a communicating port, through which the damper chamber and the liquid supply flow channel communicate with each other, in a state where the base member is bonded to the bonding surface of the flexible member and closes the opening, and the flexible member is disposed such that the swollen portion is swollen in a gravity direction.

14 Claims, 13 Drawing Sheets

FOREIGN PATENT DOCUMENTS

| | | | | |
|---|---|---|---|---|
| JP | 2004-345251 | A | | 12/2004 |
| JP | 2005-169653 | A | | 6/2005 |
| JP | 2005-271546 | A | | 10/2005 |
| JP | 2006-231524 | A | | 9/2006 |
| JP | 2006-247886 | A | | 9/2006 |
| JP | 2006231524 | A | * | 9/2006 |
| JP | 2007-245484 | A | | 9/2007 |
| JP | 2007-245561 | A | | 9/2007 |

* cited by examiner

LIQUID DISCHARGING APPARATUS

CROSS REFERENCE TO RELATED APPLICATION

The present application claims priority from Japanese Patent Application No. 2007-257994, which was filed on Oct. 1, 2007, the disclosure of which is herein incorporated by reference in its entirety.

TECHNICAL FIELD

Apparatus consistent with the present invention relate to a liquid discharging apparatus such as an ink jet printer or the like.

BACKGROUND

Japanese unexamined patent application publication No. 2005-271546 (hereinafter called JP2005-271546) describes a related art tube supply-type ink jet printer. For example, the related art tube supply-type ink jet printer temporarily stores in a buffer tank on a carriage ink supplied from an ink cartridge through a flexible ink supply tube, and appropriately supplies ink from the buffer tank to an ink jet head. Then, ink is discharged from nozzles of the ink jet head, such that an image is recorded on a sheet or the like.

In this ink jet printer, an acceleration caused by an inertial force is applied to ink in the ink supply tube due to acceleration and deceleration of the carriage. If doing so, pressure wave is propagated to ink in the ink jet head, which adversely affects a meniscus formed in the nozzles of the ink jet head. For this reason, a damper chamber sealed with a flexible film is provided in the buffer tank on the upstream side of the ink jet head, thereby absorbing dynamic pressure applied to ink.

SUMMARY

The above described related art apparatus has a few disadvantages. For example, in recent years, with demands for compact ink jet printers, the carriage and mounting parts tend to be reduced in size, and accordingly, the damper chamber is also reduced in size. If the damper chamber is reduced in size, and the area of the flexible film is decreased, pressure change absorption performance is deteriorated.

Accordingly, it is an aspect of the present invention to achieve apparatus compactness and effectively improve damper performance.

According to an exemplary embodiment of the present invention, a liquid discharging apparatus comprises: a liquid discharging head that discharges a liquid onto a recording medium, the liquid, which is supplied from a liquid supply source, being supplied to the liquid discharging head through a liquid supply flow channel; and a damper chamber that is provided in the liquid supply flow channel to relieve pressure of the liquid in the liquid supply flow channel, the damper chamber being an internal space that is formed by bonding a flexible member to a base member, wherein the flexible member has a bonding surface that is bonded to the base member, an opening that is formed in the bonding surface, and a swollen portion that is three-dimensionally swollen from the edge of the opening to form the damper chamber, the base member has a communicating port, through which the damper chamber and the liquid supply flow channel communicate with each other, in a state where the base member is bonded to the bonding surface of the flexible member and closes the opening, and the flexible member is disposed such that the swollen portion is swollen in a gravity direction.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

An exemplary embodiment of the present invention will now be described with reference to the drawings. In the following description, a direction in which ink is discharged from an ink jet head is referred to as downward, and an opposite side thereof is referred to as upward.

Figure 1:
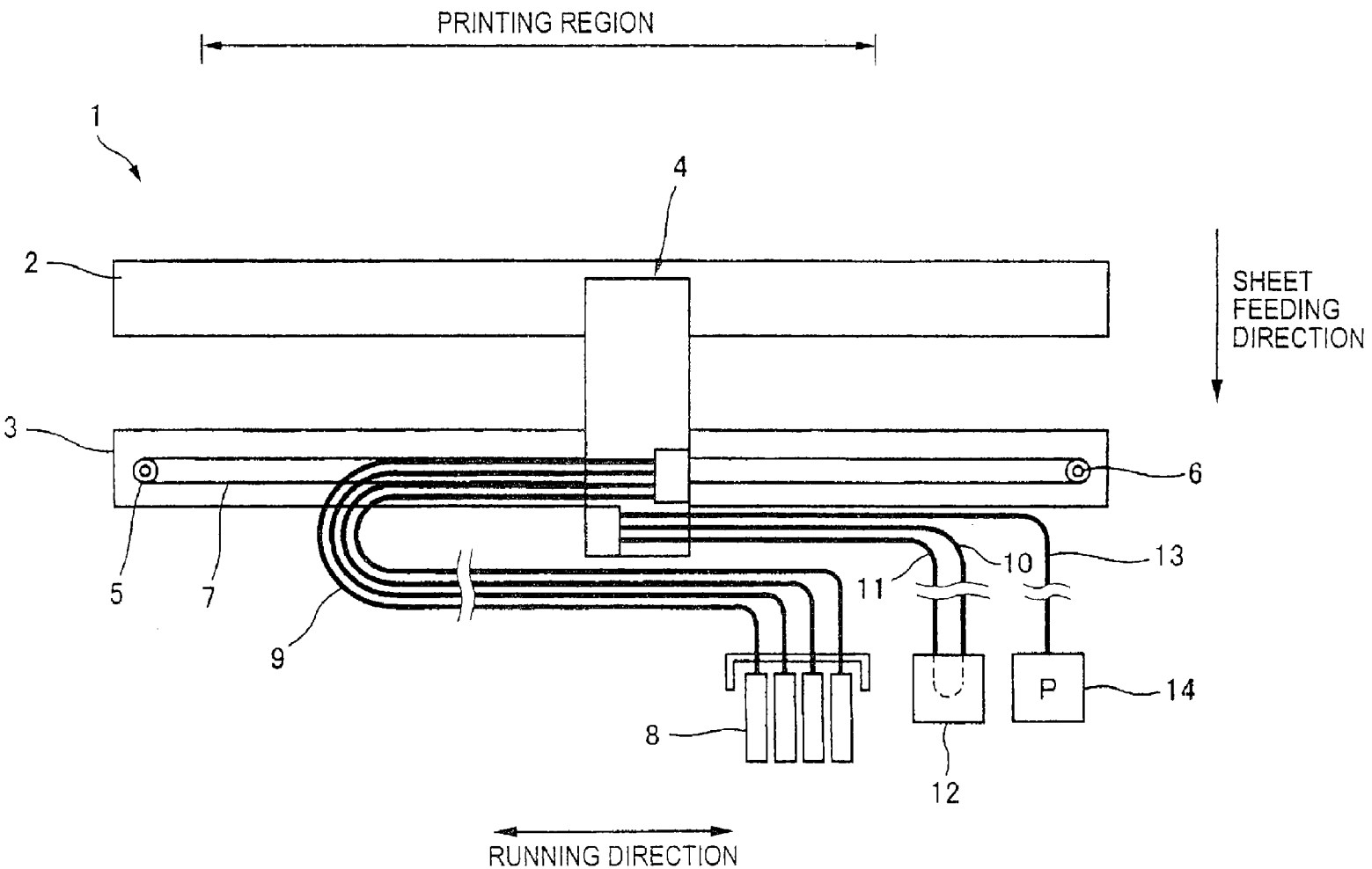
FIG. 1 is a schematic perspective view showing parts of an ink jet printer according to an exemplary embodiment of the present invention.

FIG. 1 is a schematic perspective view showing parts of an ink jet printer 1 according to an exemplary embodiment of the present invention. As shown in FIG. 1, the ink jet printer 1 (liquid discharging apparatus) is provided with a pair of guide rails 2 and 3 substantially arranged in parallel, and a head unit 4 is supported by the guide rails 2 and 3 so as to be slidable in a running direction. The head unit 4 is bonded with a timing belt 7 that is wound around a pair of pulleys 5 and 6, and the timing belt 7 is substantially arranged in parallel with an extension direction of the guide rail 3. A motor (not shown) which normally and reversely rotates is provided in one pulley 6. Normal and reverse rotation of the pulley 6 causes the timing belt 7 to reciprocate, and the head unit 4 is reciprocally moved in one direction along the guide rails 2 and 3.

Four flexible ink supply tubes 9 (liquid supply tube) to supply ink of four colors (black, cyan, magenta, and yellow) from four ink cartridges 8 (liquid supply source) are connected to the head unit 4. An ink jet head 33 (described below with reference to FIG. 4) is mounted on the head unit 4, and ink (liquid) is discharged from the ink jet head 33 toward a recording medium (for example, recording sheet) which is conveyed in a direction (sheet feed direction) perpendicular to the running direction below the ink jet head 33.

A flexible outgoing tube 10 and a flexible returning tube 11 are connected to the head unit 4. The outgoing tube 10 forms a cooling liquid outgoing channel, and the returning tube 11 forms a cooling liquid returning channel. The outgoing tube 10 and the returning tube 11 are connected so as to circulate with each other by a radiator tank 12. An end of a flexible negative pressure suction tube 13 is connected to the head unit 4. The negative pressure suction tube 13 extracts air trapped in a flow channel of the head unit 4. The other end of the negative pressure suction tube 13 is connected to a negative pressure pump 14.

Figure 2:
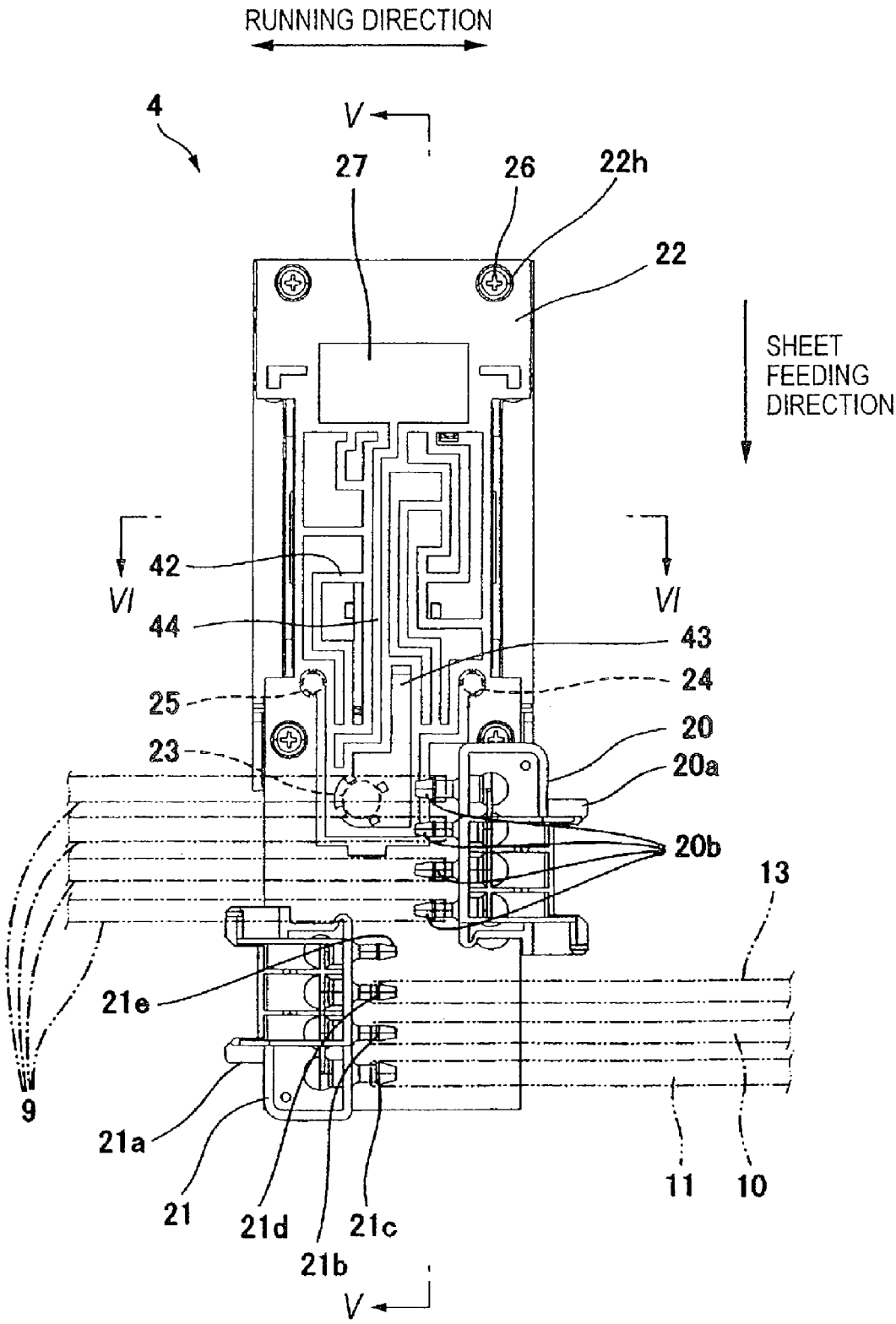
FIG. 2 is a plan view of a head unit of the ink jet printer shown in FIG. 1.
Figure 3:
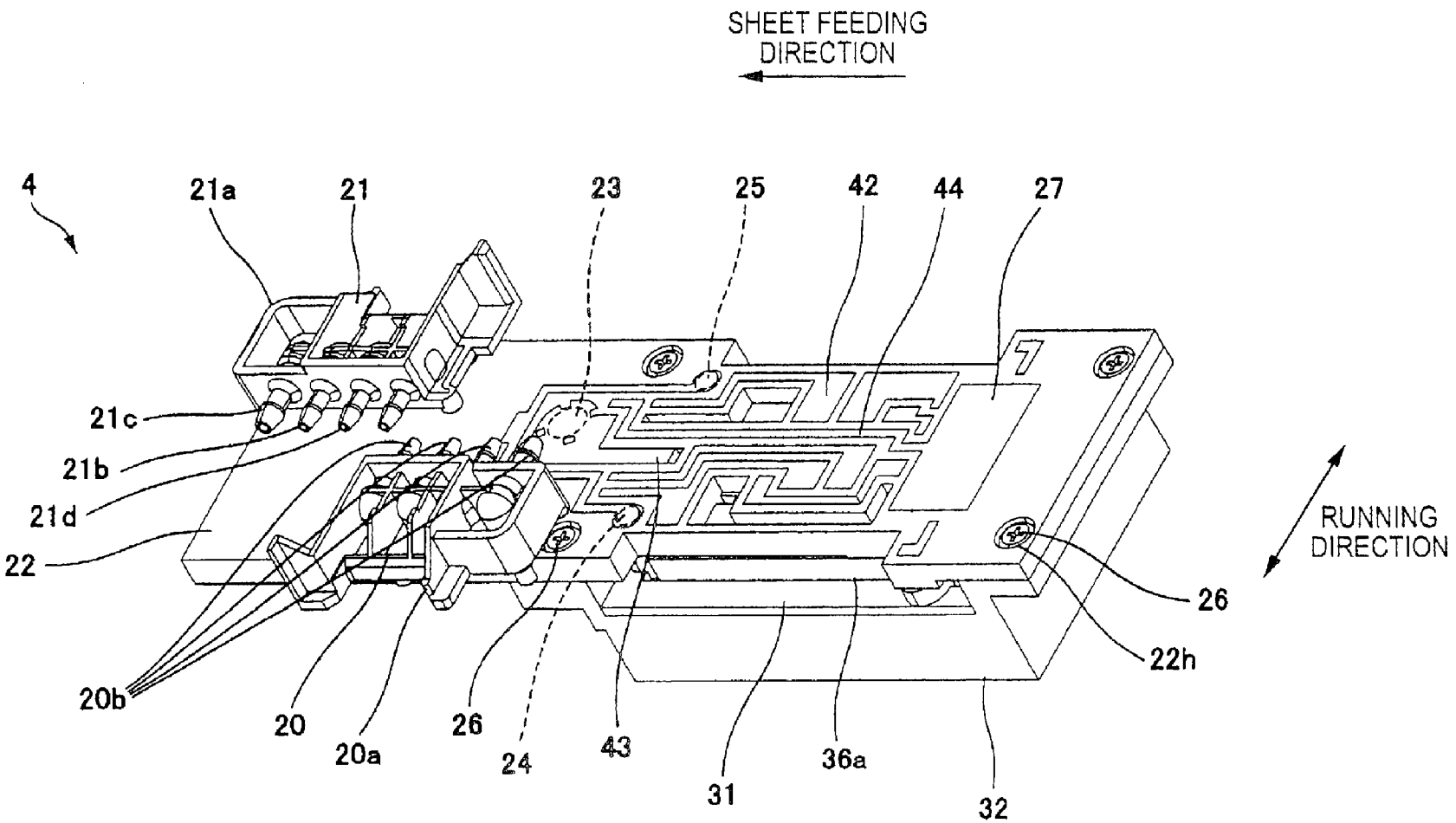
FIG. 3 is a perspective view of the head unit in the ink jet printer shown in FIG. 1.
Figure 4:
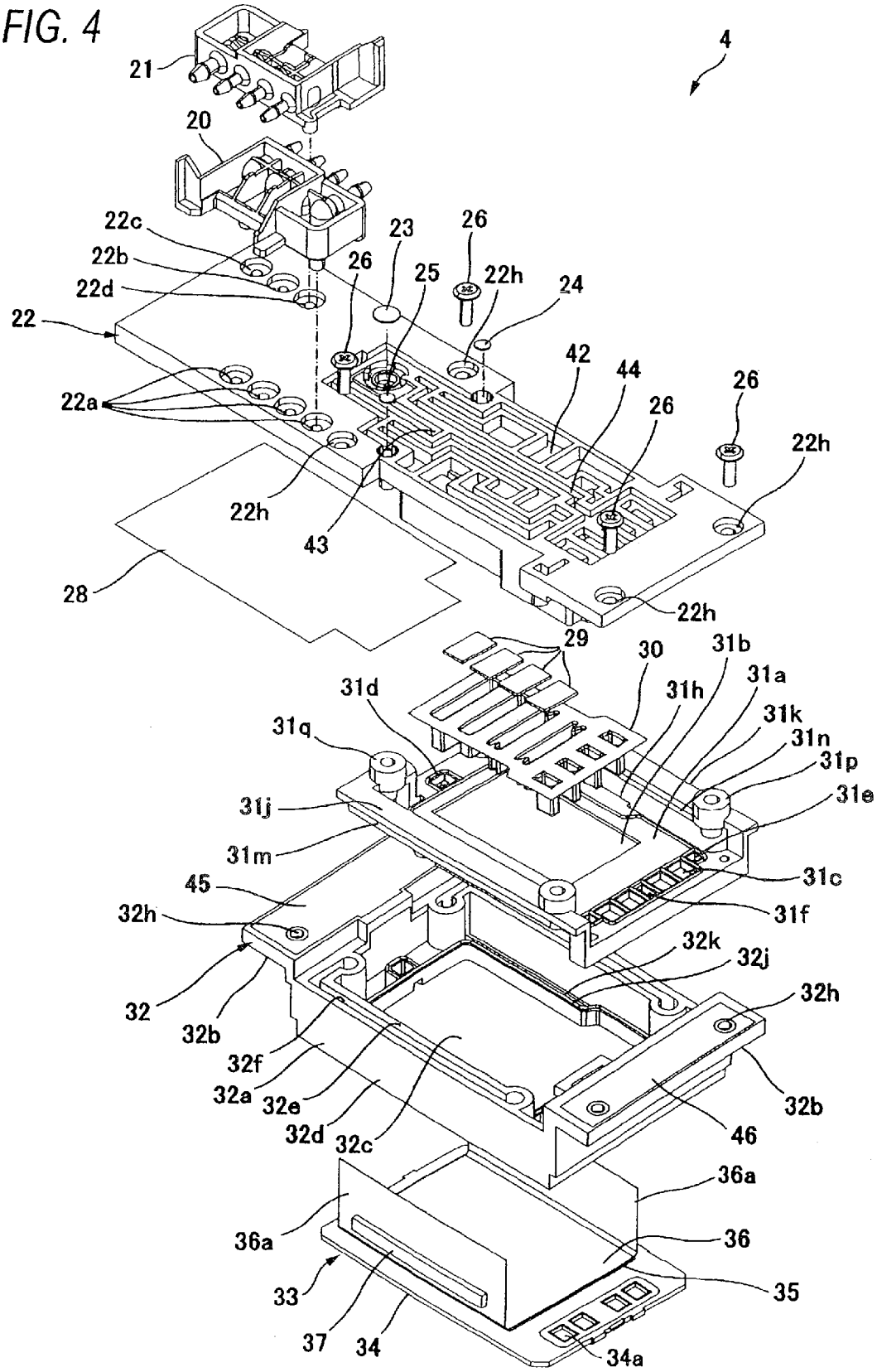
FIG. 4 is an exploded perspective view of the head unit in the ink jet printer shown in FIG. 1.

FIG. 2 is a plan view of the head unit 4 in the ink jet printer 1 shown in FIG. 1. FIG. 3 is a perspective view of the head unit 4 in the ink jet printer 1 shown in FIG. 1. FIG. 4 is an exploded perspective view of the head unit 4 in the ink jet printer 1 shown in FIG. 1. In FIG. 4, a film which is welded to an upper surface of a base member 22 is not shown. As shown in FIGS. 2 to 4, the head unit 4 includes joints 20 and 21, the base member 22, check valves 23 to 25, screws 26, air-liquid separation films 27 and 29, a flat film 28, a flexible film 30, an elastic seal member 31, a carriage 32, and the ink jet head 33.

The joint 20 for ink has a base portion 20*a* that is attached to the upper surface of the base member 22, and four ink joint tube portions 20*b* that are led from the base portion 20*a* toward one side (a left side in FIG. 2) in the running direction of the carriage 32. The ink supply tubes 9 are correspondingly connected to the ink joint tube portions 20*b*. The joint 20 is made of hard resin (for example, polypropylene), and the ink supply tubes 9 are made of soft resin (for example, nylon). The joint 20 has hardness larger than those of the ink supply tubes 9. Therefore, the environs of connection portions of the ink supply tubes 9 to the ink joint tube portions 20*b* are kept to be led to one side (the left side in FIG. 2) in the running direction of the carriage 32.

The joint 21 for cooling liquid and negative pressure suction has a base portion 21*a* that is attached to the upper surface of the base member 22, and four joint tube portions 21*b*, 21*c*, 21*d*, and 21*e* that are led from the base portion 21*a* toward the other side (a right side in FIG. 2) in the running direction of the carriage 32. Two from among the four joint tube portions 21*b*, 21*c*, 21*d*, and 21*e* are cooling liquid joint tube portions 21*b* and 21*c* for cooling liquid, one is a negative pressure joint tube portion 21*d* for negative pressure suction, and the other one is an unusable joint tube portion 21*e* (in terms of common utilization of parts, the joint 21 is the same as the joint 20 in structure, and thus an unusable joint tube portion 21*e* is provided).

The outgoing tube 10 is connected to the cooling liquid joint tube portion 21*b*, the returning tube 11 is connected to the cooling liquid joint tube portion 21*c*, and the negative pressure suction tube 13 is connected to the negative pressure joint tube portion 21*d*. The joint 21 is made of hard resin (for example, polypropylene), and the outgoing tube 10, the returning tube 11, and the negative pressure suction tube 13 are made of soft resin (for example, nylon). The joint 21 has hardness larger than the outgoing tube 10, the returning tube 11, and the negative pressure suction tube 13. Therefore, the environs of connection portions of the outgoing tube 10, the returning tube 11, and the negative pressure suction tube 13 to the cooling liquid joint tube portions 21*b*, 21*c*, and 21*d* are kept to be led to the other side (the right side in FIG. 2) in the running direction of the carriage 32.

The base member 22 substantially has a flat plate shape, and is provided with a plurality of grooves in the upper and lower surfaces. A plurality of flow channels are provided by thermally welding a film to the upper and lower surfaces so as to seal the grooves. Specifically, the base member 22 is provided with four ink inlet port 22*a* in the upper surface on a downstream side in the sheet feed direction and the other side in the running direction. The base member 22 is also provided with a cooling liquid inlet port 22*b*, a cooling liquid outlet port 22*c*, and a negative pressure suction port 22*d* in the upper surface on the downstream side of the sheet feed direction and the one side of the running direction. The base member 22 is also provided with a carriage-side ink flow channel 42 that communicates with the ink inlet ports 22*a*, a cooling liquid flow channel 43 that communicates with the cooling liquid inlet port 22*b* and the cooling liquid outlet port 22*c*, and an air exhaust flow channel 44 that communicates with the negative pressure suction port 22*d*.

Three check valves 23 to 25 are arranged in the cooling liquid flow channel 43. The check valves 23 to 25 permits the flow of the cooling liquid from the cooling liquid inlet port 22*b* toward the cooling liquid outlet port 22*c*, and checks the flow of the cooling liquid from the cooling liquid outlet port 22*c* toward the cooling liquid inlet port 22*b*. Specifically, at a place where the flow of the cooling liquid from the cooling liquid inlet port 22*b* toward the cooling liquid outlet port 22*c* is directed from the lower surface of the base member 22 toward the upper surface, a lower-side small diameter flow channel and a large diameter flow channel connected to an upper side of the small diameter flow channel are provided in the cooling liquid flow channel 43. And, waterproof films are arranged in the large diameter flow channel as the check valves 23 to 25. The check valves 23 to 25 have a diameter larger than that of the small diameter flow channel and smaller than that of the large diameter flow channel, and has a specific gravity larger than that of the cooling liquid to be then freely floated. Therefore, if the cooling liquid goes from the cooling liquid inlet port 22*b* toward the cooling liquid outlet port 22*c*, the check valves 23 to 25 are floated and communicate with the small diameter flow channel and the large diameter flow channel. If the cooling liquid goes from the cooling liquid outlet port 22*c* toward the cooling liquid inlet port 22*b*, the check valves 23 to 25 are sunken and close the small diameter flow channel. Through holes 22*h* into which the screws 26 are inserted are provided at required places of the base member 22.

Figure 5:
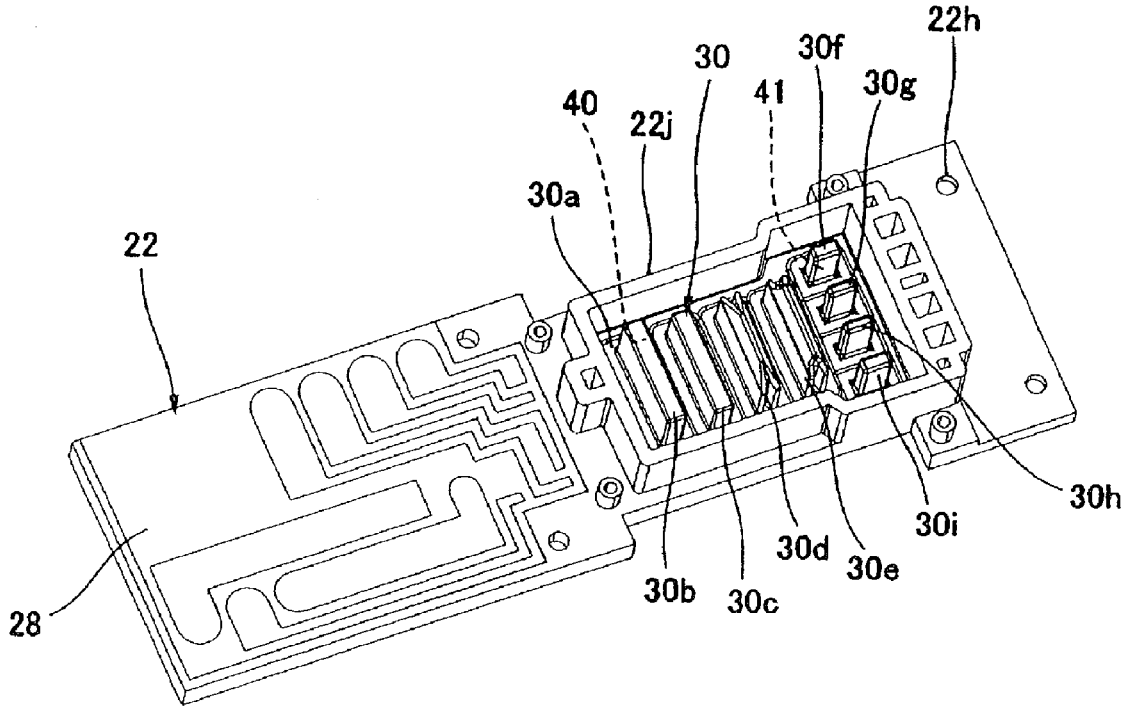
FIG. 5 is a perspective view of a base member and a flexible film shown of the head unit in FIG. 4 when viewed from the below.

FIG. 5 is a perspective view when the base member 22 and the flexible film 30 in the head unit 4 shown in FIG. 4 are viewed from the below. As shown in FIG. 5, various flow channels are formed by sealing the grooves in the lower surface of the base member 22 with the flat film 28. A peripheral rib 22*j* is formed in the lower surface of the base member 22 to protrude downward. The flexible film 30 is thermally welded inside the peripheral rib 22*j*. The flexible film 30 is three-dimensionally hot formed by a matched molding method and is made of a thin film resin. Large ink damper chambers 40 and small ink damper chambers 41 as parts of the ink flow channels are formed between the lower surface of the base member 22 and the flexible film 30 to lesson a change in pressure of ink.

Figure 6:
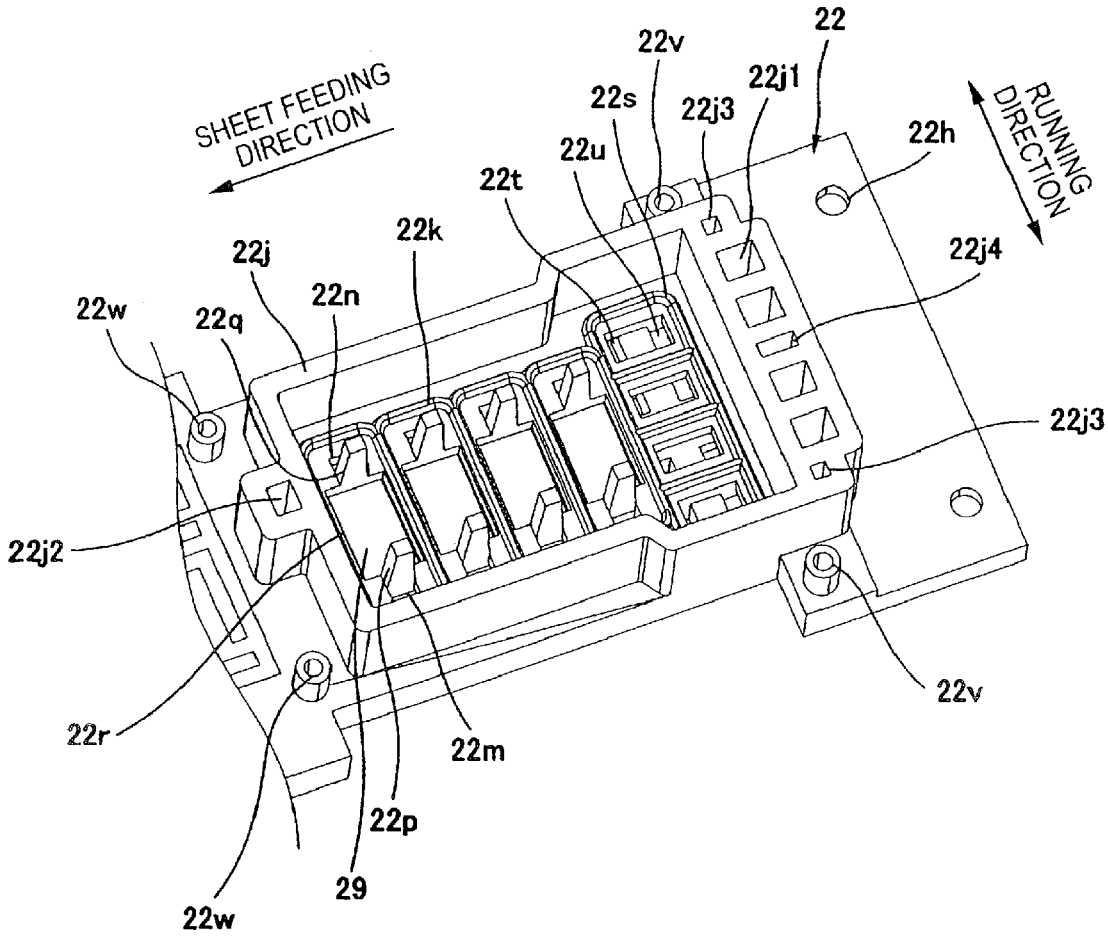
FIG. 6 is an enlarged perspective view of parts of the base member shown in FIG. 5 when viewed from the below.

FIG. 6 is an enlarged perspective view of parts of the base member 22 shown in FIG. 5 when viewed from the below. As shown in FIG. 6, large peripheral uplifted portions 22*k* are provided inside the peripheral rib 22*j* in the lower surface of the base member 22, and the flexible film 30 is welded to the large peripheral uplifted portions 22*k*. The large peripheral uplifted portions 22*k* are arranged in a longitudinal direction (sheet feed direction) of the base member 22 so as to partition the large ink damper chamber 40 (see FIG. 5), which substantially has a rectangular shape in plan view, for each of four kinds of ink. Small peripheral uplifted portions 22*s* are provided adjacent to the large peripheral uplifted portions 22*k*. The small peripheral uplifted portions 22*s* are arranged in a widthwise direction (the running direction) of the base member 22 so as to partition the small ink damper chamber 41 (see FIG. 5), which substantially has a rectangular shape in plan view, for each of four kinds of ink.

Inside each of the large peripheral uplifted portions 22*k* of the lower surface of the base member 22, an inlet port 22*m* and an outlet port 22*n* are formed on both sides in the long-side direction (running direction). The inlet port 22*m* and the outlet port 22*n* are holes that communicate with the carriage-side ink flow channel 42 in the upper surface of the base member 22. Protrusions 22*p* and 22*q* are provided between the inlet port 22*m* and the outlet port 22*n* to protrude toward the large ink damper chamber 40 in each of large swollen portions 30*b* to 30*e* (described below) of the flexible film 30. The protrusions 22*p* and 22*q* are provided so as not to be in contact with swollen portions 30*b* to 30*e* in a state where the large swollen portions 30*b* to 30*e* (described below) are at atmospheric pressure. A film attaching portion 22*r* to which air-liquid separation film 29 (semipermeable film) is attached is recessed between the protrusion 22*p* and the protrusion 22*q* to substantially have a rectangular shape in plan view. The air-liquid separation film 29 transmits gas but does not transmit a liquid. The air-liquid separation film 29 attached to the film attaching portion 22*r* is opposed to an opening 30*x* of each of the large swollen portions 30*b* to 30*e* (described below). A hole 22*x* (see FIG. 9) is provided in the film attaching portion 22*r* to communicate with the air exhaust flow channel 44 in the upper surface of the base member 22.

Inside each of the small peripheral uplifted portions 22*s* in the base member 22, an inlet port 22*t* and an outlet port 22*u* are formed on both sides of the long-side direction (sheet feed direction). The inlet port 22*t* and the outlet port 22*u* are holes that communicate the carriage-side ink flow channel 42 in the upper surface of the base member 22. In the peripheral rib 22*j* of the base member 22, four ink channels 22*j*1 are formed in an up-down direction to communicate with the outlet ports 22*u* on the upper surface side of the base member 22. The air-liquid separation film 27 is attached to the upper surface of the base member 22 to cover positions corresponding to the ink channels 22*j*1 and the outlet ports 22*u*. The air-liquid separation film 27 transmits gas but does not transmit a liquid.

On a downstream side in the sheet feed direction of the peripheral rib 22*j* of the base member 22, a cooling liquid channel 22*j*2 is formed in which the cooling liquid from the cooling liquid flow channel 43 flows downward. On a front side in the sheet feed direction of the peripheral rib 22*j* of the base member 22, a pair of cooling liquid channels 22*j*3 are formed on both sides in the running direction, in which the cooling liquid from a cooling liquid damper chamber 49 flows upward. Near the cooling liquid channels 22*j*3 outside the peripheral rib 22*j* of the base member 22, a pair of cooling liquid channel cylindrical portions 22*v* are formed in which the cooling liquid flows downward. On the downstream side in the sheet feed direction outside the peripheral rib 22*j* of the base member 22, a pair of cooling liquid channel cylindrical portions 22*w* are formed in which the cooling liquid from an IC chip cooling channel 51. In the peripheral rib 22*j* of the base member 22, a cooling liquid channel 22*j*4 through which the cooling liquid damper chamber 49 (described below) communicates with the air-liquid separation film 27 is formed in the up-down direction between the inside two ink channels 22*j*1.

Figure 7:
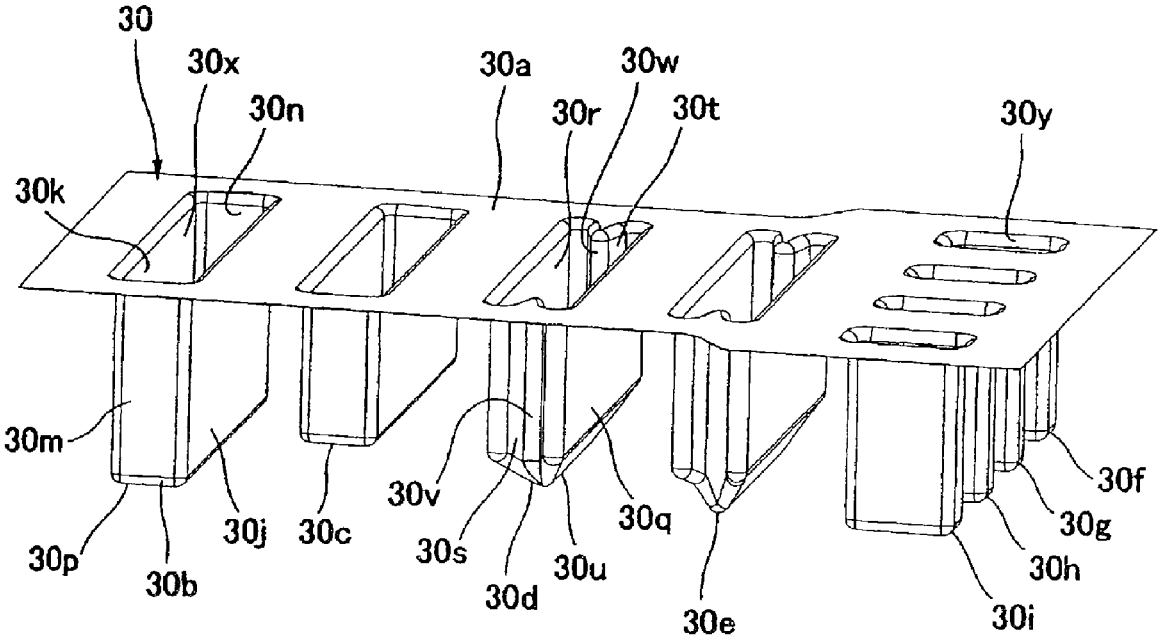
FIG. 7 is a perspective view of the flexible film shown in FIG. 5 when viewed from the above.

FIG. 7 is a perspective view of the flexible film 30 shown in FIG. 5 when viewed from the above. As shown in FIG. 7, the flexible film 30 has a bonding surface 30*a*, openings 30*x* and 30*y*, and large swollen portions 30*b* to 30*e* and small swollen portions 30*f* to 30*i*. The bonding surface 30*a* is bonded to the large peripheral uplifted portions 22*k* and the small peripheral uplifted portions 22*s* (see FIG. 6) of the base member 22. The openings 30*x* and 30*y* are formed in the bonding surface 30*a* and have a rectangular shape to be slightly smaller than the large peripheral uplifted portions 22*k* and the small peripheral uplifted portions 22*s* (see FIG. 6). The large swollen portions 30*b* to 30*e* and the small swollen portions 30*f* to 30*i* (recording liquid flexible walls) are three-dimensionally swollen from the edges of the opening 30*x* and 30*y* in a gravity direction away from the base member 22 (see FIG. 5). Therefore, by bonding the bonding surface 30*a* of the flexible film 30 to the base member 22 to close the openings 30*x* and 30*y*, the inner spaces of the four large swollen portions 30*b* to 30*e* form the large ink damper chambers 40 as parts of four kinds of ink flow channels. Further, the inner spaces of the four small swollen portions 30*f* to 30*i* form the small ink damper chambers 41 as parts of four kinds of ink flow channels. That is, as for one kind of ink, the large ink damper chamber 40 is disposed on the upstream side and the small ink damper chamber 41 is disposed on the downstream side. That is, a plurality of ink damper chambers 40 and 41 are disposed in one carriage-side ink flow channel 42.

The large swollen portions 30*b* to 30*e* individually have a pair of main surfaces 30*j*, 30*k*, 30*q*, and 30*r* that protrude from the edge of the long side of the opening 30*x* in the gravity direction and are opposed to each other, a pair of sub surfaces 30*m*, 30*n*, 30*s*, and 30*t* that protrude from the edge of the short side of the opening 30*x* in the gravity direction and are opposed to each other, and sub surfaces 30*p* and 30*u* that connect the main surfaces 30*j*, 30*k*, 30*q*, and 30*r* and the sub surfaces 30*m*, 30*n*, 30*s*, and 30*t*. That is, by bending the main surfaces 30*j*, 30*k*, 30*q*, and 30*r* of a large area to cause a large change in volume of the spaces in the large swollen portions 30*b* to 30*e*, when viewed from the above in plan view, even though the areas of the large swollen portions 30*b* to 30*e* are small, a large pressure change absorption effect can be obtained.

The large swollen portion 30*b* and the large swollen portion 30*c* substantially have the same shape but different lengths in the gravity direction. In the sub surfaces 30*s* and 30*t* of the large swollen portion 30*d* and the large swollen portion 30*e*, dent portions 30*v* and 30*w* are provided, the sections of which perpendicular to the main surfaces 30*q* and 30*r* have a dent shape. The sub surfaces 30*u* of the large swollen portion 30*d* and the large swollen portion 30*e* are crest portions whose sections perpendicular to the main surfaces 30*q* and 30*r* are crest shapes. With a cornice effect of the dent- or crest-shaped sub surfaces 30*s*, 30*t*, and 30*u*, the main surfaces 30*q* and 30*r* can move in the normal direction. Therefore, even though the areas of the large swollen portions 30*d* and 30*e* in plan view are small, a larger pressure change absorption effect can be obtained. The small swollen portions 30*f* to 30*i* substantially have the same as the large swollen portions 30*b* and 30*c* but different in size, and thus detailed descriptions thereof will be omitted. Moreover, the dent portions or the crest portions may be provided in the sub surfaces of all of the large swollen portions 30*b* to 30*e*, or may not be provided.

Returning to FIG. 4, the elastic seal member 31 is made of an elastic material, such as rubber, and has a flat plate portion 31*a* substantially having a rectangular shape in plan view. In the central portion of an upper surface of the flat plate portion 31*a*, a concave portion 31*b* is formed to correspond to the large swollen portions 30*b* to 30*e* and the small swollen portions 30*f* to 30*i* of the flexible film 30. The concave portion

31*b* has a rectangular shape in plan view and is thinned. In the end surfaces on both sides of the flat plate portion 31*a* in the running direction, press portions 31*h* are individually provided to protrude toward IC chips 37 (described below).

On the upstream side of the flat plate portion 31*a* in the sheet feed direction (longitudinal direction), four ink holes 31*c* are formed to communicate liquid-tight with the four ink channels 22*j*1 (see FIG. 6) of the base member 22. On the downstream side of the flat plate portion 31*a* in the sheet feed direction, a cooling liquid hole 31*d* is formed to communicate liquid-tight with the cooling liquid channel 22*j*2 (see FIG. 6) of the base member 22. On both sides of the ink hole 31*c* of the flat plate portion 31*a* in the running direction, a pair of cooling holes 31*e* are formed to communicate light-tight with the pair of cooling liquid channels 22*j*3 (see FIG. 6) of the base member 22. A cooling hole 31*f* is formed between the inside two ink holes 31*c* from among the four ink holes 31*c* of the flat plate portion 31*a* to communicate light-tight with the cooling liquid channel 22*j*4 (see FIG. 6) of the base member 22.

Above both sides of the flat plate portion 31*a* in the running direction, a pair of rod portions 31*j* and 31*k* which are connected to the flat plate portion 31*a* as a single body extend along the longitudinal direction of the flat plate portion 31*a*. In the lower surfaces of the rod portions 31*j* and 31*k*, strip protrusions 31*m* and 31*n* are formed. The strip protrusions 31*m* and 31*n* are pressed into and seal grooves 31*f* (described below) of the carriage 32, in which the cooling liquid flows, from the above. On the upstream sides of the rod portions 31*j* and 31*k* in the sheet feed direction, a pair of cooling liquid channel cylindrical portions 31*p* are formed to communicate liquid-tight with the pair of cooling liquid channel cylindrical portions 22*v* (see FIG. 6) of the base member 22, respectively. On the downstream sides of the rod portions 31*j* and 31*k* in the sheet feed direction, a pair of cooling liquid channel cylindrical portions 31*q* are formed to communicate liquid-tight with the pair of cooling liquid channel cylindrical portions 22*w* (see FIG. 6) of the base member 22, respectively.

The carriage 32 is made of resin, and has a concave portion 32*a*, and rail guide portions 32*b* that protrude in a flange shape from upper ends on both sides of the concave portion 32*a* in the sheet feed direction (longitudinal direction) and are guided to the guide rails 2 and 3 (see FIG. 1). The rail guide portions 32*b* are provided with screw holes 32*h* to which the screws 26 are fastened. The concave portion 32*a* is provided with an ink hole 32*g*, which communicates liquid-tight with the ink holes 31*c* of the elastic seal member 31, on the upstream side of a bottom wall portion 32*c* thereof in the sheet feed direction (longitudinal direction). Both sides of the concave portion 32*a* in the running direction have a double walled structure having an outer wall portion 32*d* and an inner wall portion 32*e*. A groove 32*f* is formed between the outer wall portion 32*d* and the inner wall portion 32*e* to form the IC chip cooling channel 51. Heat sinks 45 and 46 made of a metal, such as aluminum, are embedded in the inner wall portion 32*e* and the rail guide portions 32*b* by insert molding, respectively. At the bottom wall portion 32*c* inside the inner wall portion 32*e*, a seal mounting portion 32*j* protrudes upward at a position corresponding to the peripheral rib 22*j* of the base member 22. A slit 32*k* is provided at the bottom wall portion 32*c* between the seal mounting portion 32*j* and the inner wall portion 32*e*, and extended portions 36*a* and 36*b* of a flexible flat wire member 36 are inserted into the slit 32*k* from downward to upward.

The ink jet head 33 is attached to the lower side of the bottom wall portion 32*c* of the carriage 32. The ink jet head 33 has a flow channel unit 34 that has a plurality of ink chambers for guiding ink from the four ink inlet ports 34*a* to a plurality of nozzles (not shown), and a piezoelectric actuator 35 that is laminated on the upper surface of the flow channel unit 34 and selectively gives ejection pressure to ink in the flow channel unit 34 so as to be directed toward the nozzles. The ink inlet ports 34*a* of the flow channel unit 34 are covered with a filter 38. The ink inlet ports 34*a* communicate liquid-tight with the ink hole 32*g* of the carriage 32.

The flexible flat wire member 36 is bonded to the upper surface of the actuator 35. The flexible flat wire member 36 has a pair of extended portions 36*a* and 36*b* that extend from the upper surface of the actuator 35 toward both sides of the running direction. Actuator driving IC chips 37 are provided on the lower surfaces of the pair of extended portions 36*a* and 36*b* (on the outer surfaces when the pair of extended portions 36*a* and 36*b* turn upward).

Figure 8:
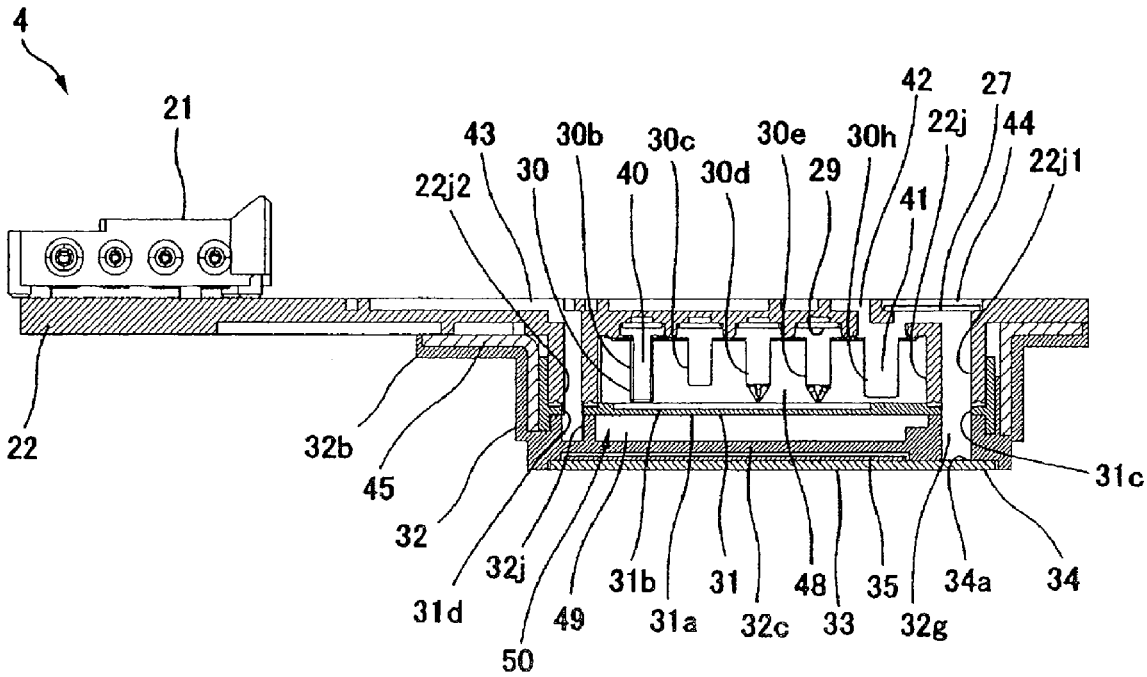
FIG. 8 is a sectional view taken along the line V-V of FIG. 2.
Figure 9:
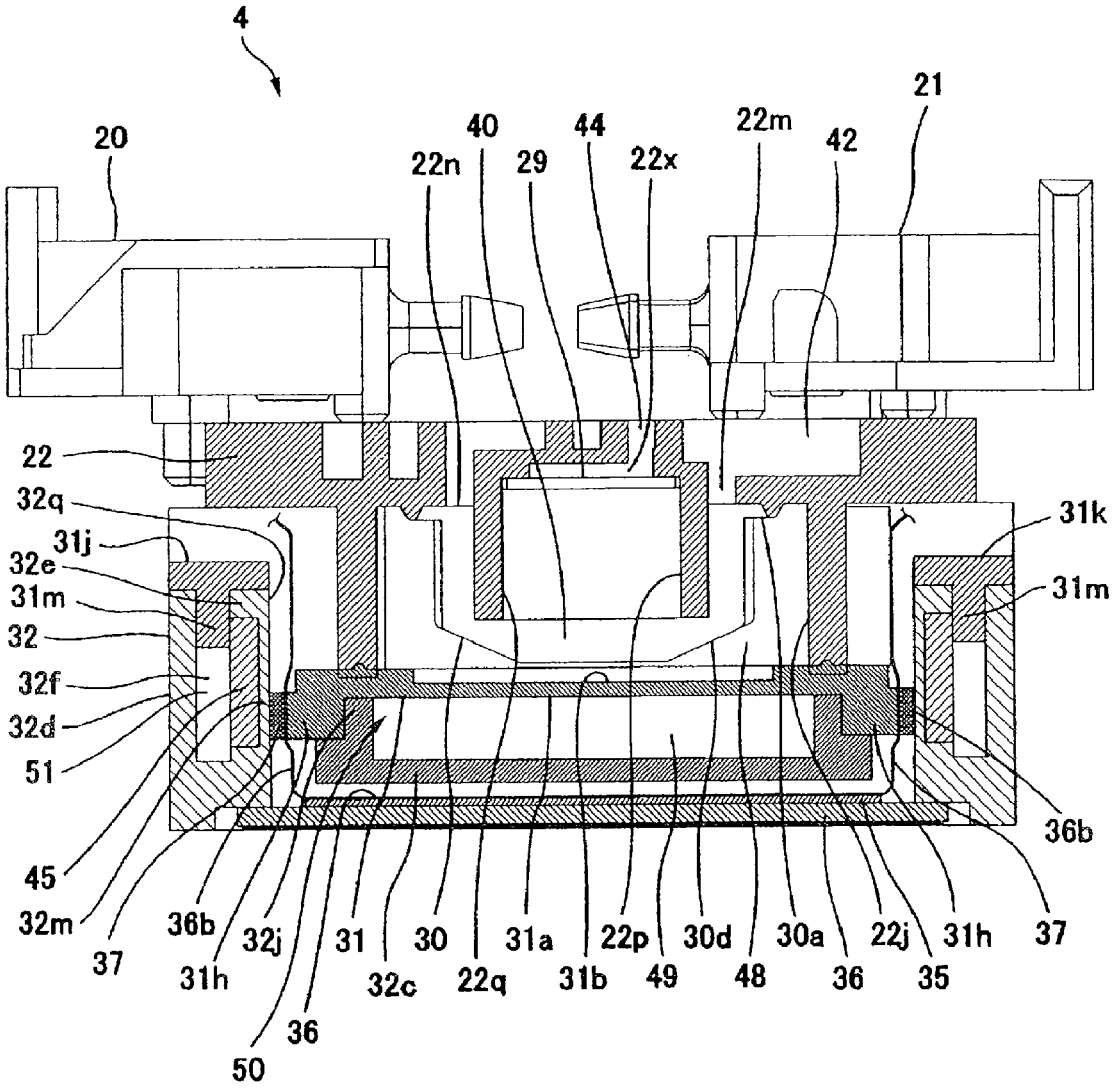
FIG. 9 is a sectional view taken along the line VI-VI of FIG. 2.

FIG. 8 is a sectional view taken along the line V-V of FIG. 2. FIG. 9 is a sectional view taken along the line VI-VI of FIG. 2. As shown in FIGS. 8 and 9, the flat plate portion 31*a* of the elastic seal member 31 is sandwiched between the peripheral rib 22*j* of the base member 22 and the seal mounting portion 32*j* of the carriage 32. The cooling liquid damper chamber 49 is formed in a space defined by the lower surface of the elastic seal member 31, the upper surface of the bottom wall portion 32*c* of the carriage 32, and an inner peripheral surface of the seal mounting portion 32*j* of the carriage 32. The cooling liquid damper chamber 49 forms a part of the cooling liquid flow channel 43, and is provided at a position corresponding to the actuator 35 of the ink jet head 33. The cooling liquid damper chamber 49 and the actuator 35 are disposed to be close each other with the bottom wall portion 32*c* interposed therebetween. That is, the cooling liquid damper chamber 49 also functions as an actuator cooling flow channel for cooling the actuator 35. An air layer 48 is formed in a closed space defined by the upper surface of the flat plate portion 31*a* of the elastic seal member 31, the outer surface of the flexible film 30, and an inner peripheral surface of the peripheral rib 22*j* of the base member 22.

The ink damper chambers 40 and 41 and the cooling liquid damper chamber 49 are separated from each other by the swollen portions 30*h* to 30*i* of the flexible film 30, the flat plate portion 31*a* of the elastic seal member 31, and the air layer 48. That is, the swollen portions 30*b* to 30*i*, the flat plate portion 31*a*, and the air layer 48 form a pressure transmission unit 50 that enables the ink damper chambers 40 and 41 and the cooling liquid damper chamber 49 to transmit pressure to each other.

As shown in FIG. 9, the protrusions 22*p* and 22*q* protrude in the large ink damper chamber 40 inside the large swollen portion 30*d* of the flexible film 30 so as not to be in contact with the large swollen portion 30*d*. Ink flowing from the inlet port 22*m* into the large ink damper chamber 40 goes round the protrusion 22*p* and flows in the central portion of the large ink damper chamber 40. Air bubbles of ink in the central portion of the large ink damper chamber 40 are raised by a buoyant force and guided to the air exhaust flow channel 44 through the air-liquid separation film 29. Then, ink in the central portion of the large ink damper chamber 40 goes round the protrusion 22*q* and flows in the outlet port 22*n*.

The strip protrusions 31*m* and 31*n* in the rod portions 31*j* of the elastic seal member 31 are pressed into the groove 32*f* which is formed between the outer wall portion 32*d* and the inner wall portion 32*e* of the carriage 32, thereby forming the IC chip cooling channel 51. The IC chip cooling channel 51 communicates with the cooling liquid flow channel 43 and the cooling liquid damper chamber 49. The heat sink 45 is formed at the inner wall portion 32*e* so as to be exposed to the cooling liquid flow channel 51 by insert molding and also functions as an inner wall portion. The extended portions 36*a* and 36*b* of the flexible flat wire member 36 pass through upward between the inner wall portion 32*e* of the carriage 32 and the flat plate portion 31*a* of the elastic seal member 31. The IC chip 37 is pressed against the inner wall portion 32*e* by the press portion 31*h* of the elastic seal member 31. That is, the IC chip 37 comes into contact with an outer surface 32*q* of a thin covering portion 32*m* that is made of resin and covers the heat sink 45 of the inner wall portion 32*e* of the carriage 32.

Figure 10:
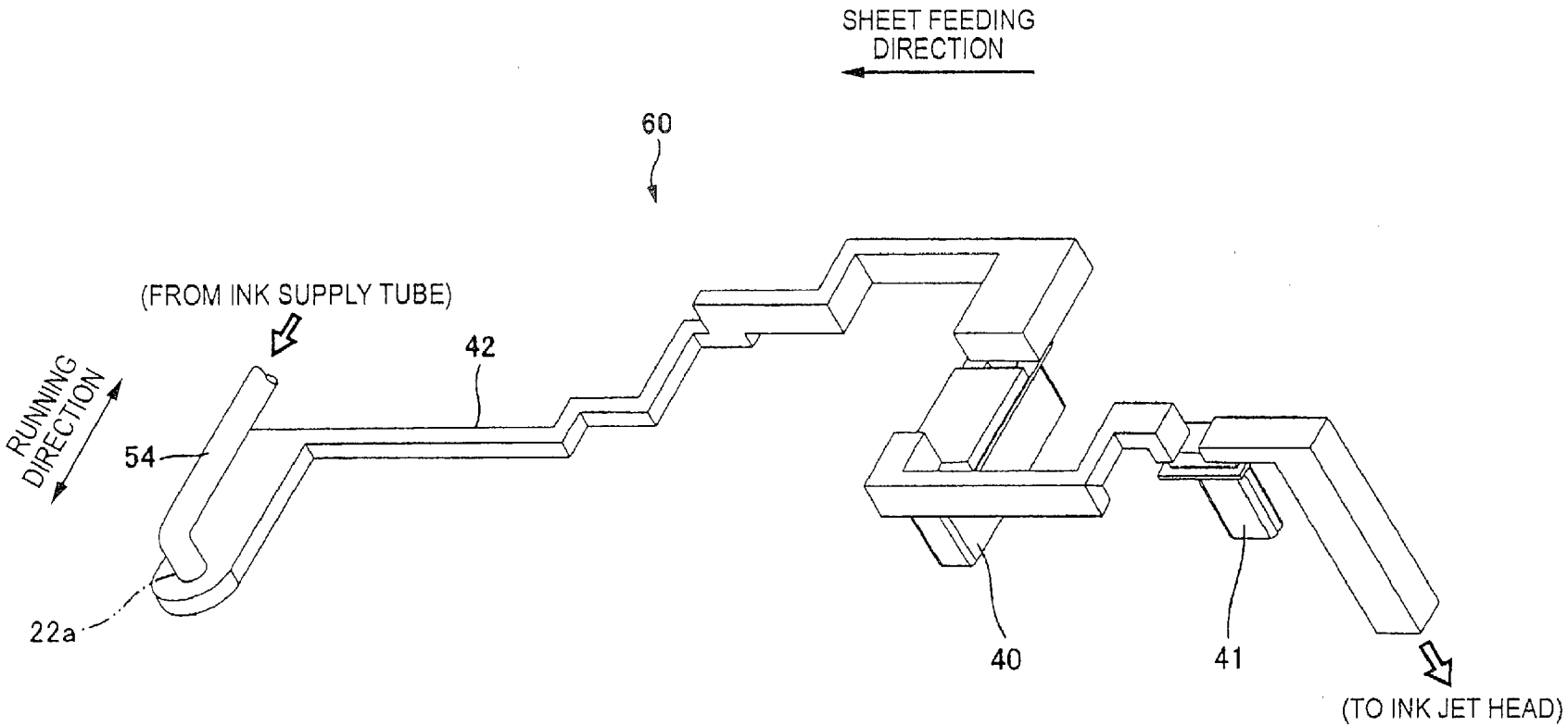
FIG. 10 is a perspective view showing one from among four ink flow channels in the head unit shown in FIG. 4.

FIG. 10 is a perspective view showing one from among the four carriage-side ink flow channels 42 in the head unit 4 shown in FIG. 4. As shown in FIGS. 2 and 10, the carriage-side ink flow channel 42 has a lead portion 54 that is led from the head unit 4 on one side of the running direction. The lead portion 54 is formed by an inner flow channel of the ink joint tube portions 20*b* of the joint 20 and an inner flow channel near the connection portions of the ink supply tubes 9 to the ink joint tube portions 20*b*. Moreover, an ink flow channel 60 (liquid flow channel) from the ink cartridge 8 to the ink jet head 33 is formed by a flow channel in the ink supply tubes 9 and the carriage-side ink flow channel 42.

Figure 11:
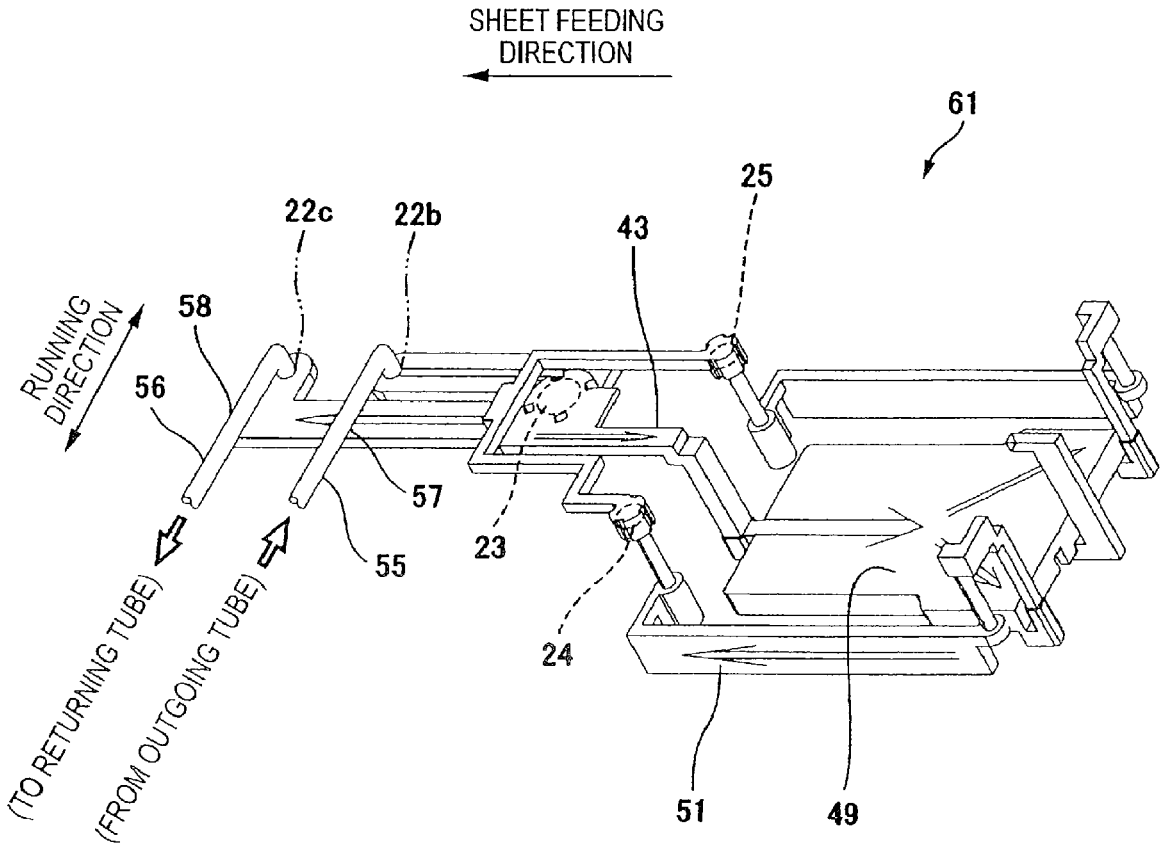
FIG. 11 is a perspective view of a cooling liquid flow channel in the head unit shown in FIG. 4.

FIG. 11 is a perspective view of the cooling liquid flow channel 43 in the head unit 4 shown in FIG. 4. As shown in FIGS. 2, 4, and 11, the cooling liquid flow channel 43 communicates with a cooling liquid outgoing channel 55 connected to the cooling liquid inlet port 22*b* and a cooling liquid returning channel 56 connected to the cooling liquid outlet port 22*c*. The cooling liquid outgoing channel 55 is formed by an inner flow channel of the cooling liquid joint tube portion 21*b* of the joint 21, and an inner flow channel of the outgoing tube 10. The cooling liquid returning channel 56 is formed by an inner flow channel of the cooling liquid joint tube portion 21*c* of the joint 21 and an inner flow channel of the returning tube 11.

By determining the inner diameter of the cooling liquid returning channel 56 to be larger than the inner diameter of the cooling liquid outgoing channel 55, the cooling liquid returning channel 56 has flow channel resistance smaller than flow channel resistance of the cooling liquid outgoing channel 55. The inner diameters of the outgoing tube 10 and the returning tube 11 are larger than the inner diameter of each of the ink supply tubes 9, and the outgoing tube 10 and the returning tube 11 have hardness lower than hardness of the ink supply tubes 9.

The cooling liquid outgoing channel 55 and the cooling liquid returning channel 56 individually have lead portions 57 and 58 that are led from the head unit 4 toward the other side of the running direction. The lead portions 57 and 58 are individually formed by inner flow channels of the cooling liquid joint tube portions 21*b* and 21*c* of the joint 21, and inner flow channels near connection portions of the outgoing tube 10 and the returning tube 11 to the cooling liquid joint tube portions 21*b* and 21*c*. The check valve 23 is provided on the upstream side of the cooling liquid damper chamber 49 and the downstream side of the lead portion 57, and the check valves 24 and 25 are provided on the downstream side of the cooling liquid damper chamber 49 and the upstream side of the lead portion 58. A cooling liquid circulation flow channel 61 is formed by a flow channel in the radiator tank 12, a flow channel in the outgoing tube 10, a flow channel in the joint 21, the cooling liquid flow channel 43, and a flow channel in the returning tube 11.

Figure 12:
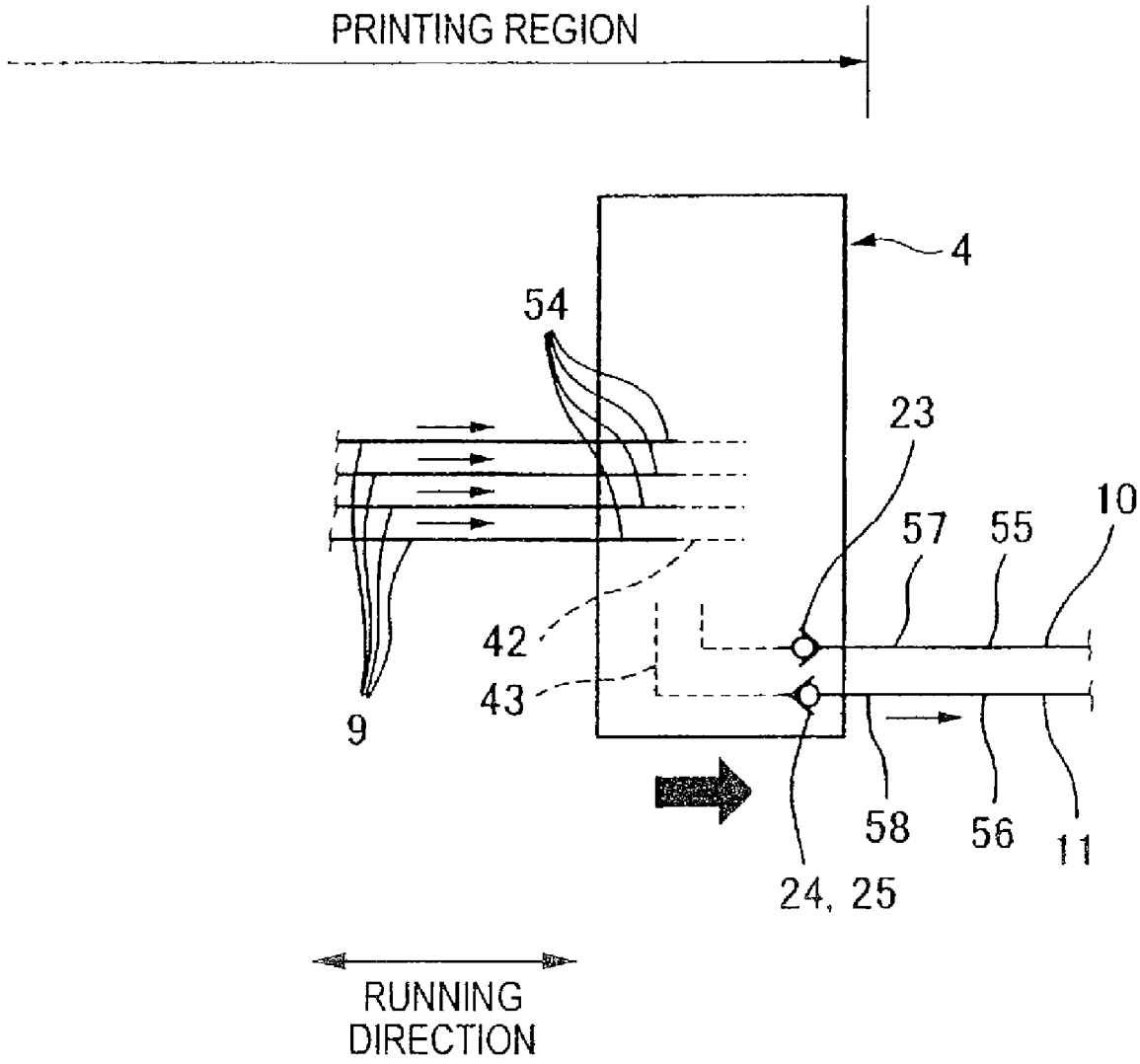
FIG. 12 is a schematic view showing a case where the head unit shown in FIG. 2 is turned at a right end.

FIG. 12 is a schematic view showing a case where the head unit 4 shown in FIG. 2 is turned at a right end (the other end). As shown in FIG. 12, when the head unit 4 is turned at the right end in the running direction, the head unit 4 is decelerated at a predetermined deceleration and is stopped at the right end, and then moves rightward while being accelerated at a predetermined acceleration. Therefore, positive pressure is applied to the carriage-side ink flow channel 42 due to an inertial force of ink in the lead portion 54 of the carriage-side ink flow channel 42. Meanwhile, negative pressure is applied to the cooling liquid flow channel 43 due to an inertial force of the cooling liquid in the lead portion 58 of the cooling liquid returning channel 56. That is, the cooling liquid from the cooling liquid flow channel 43 does not flow back to the cooling liquid outgoing channel 55 due to the check valve 23, but it passes through the check valves 24 and 25 and flows out to the cooling liquid returning channel 56. Therefore, negative pressure is generated in the cooling liquid flow channel 43. Then, if an inertial force in a right direction of the running direction applied to the cooling liquid in the lead portion 57 of the cooling liquid outgoing channel 55 is eliminated, the cooling liquid in the cooling liquid outgoing channel 55 passes through the check valve 23 and flows into the cooling liquid flow channel 43 due to the negative pressure of the cooling liquid flow channel 43.

Figure 13:
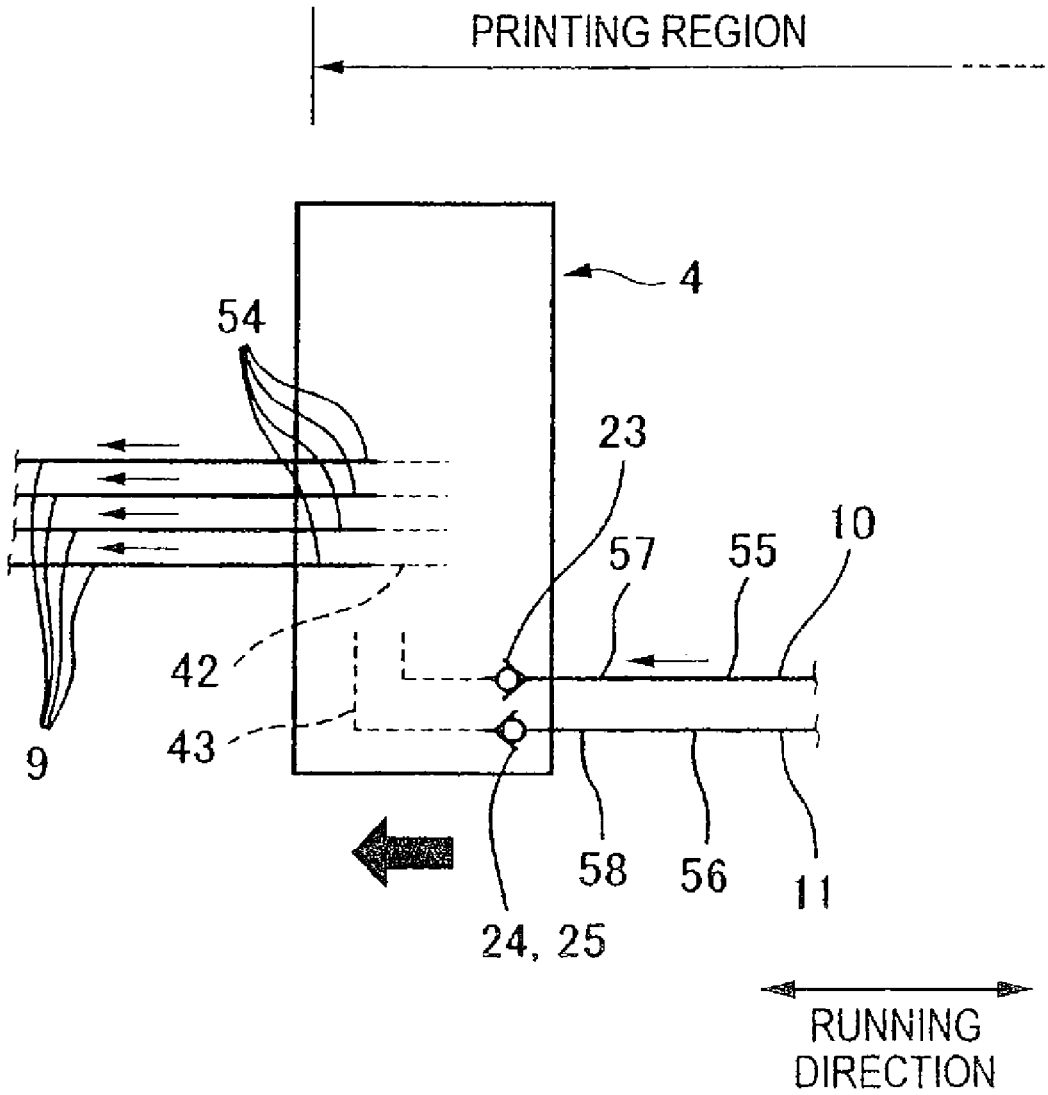
FIG. 13 is a schematic view showing a case where the head unit shown in FIG. 2 is turned at a left end.

FIG. 13 is a schematic view showing a case where the head unit 4 shown in FIG. 2 is turned at a left end. As shown in FIG. 13, when the head unit 4 is turned at the right end in the running direction, negative pressure is applied to the carriage-side ink flow channel 42 due to the inertial force of ink in the lead portion 54 of the carriage-side ink flow channel 42. Meanwhile, positive pressure is applied to the cooling liquid flow channel 43 due to the inertial force of the cooling liquid in the lead portion 57 of the cooling liquid outgoing channel 55. That is, the cooling liquid from the cooling liquid outgoing channel 55 passes through the check valve 23 and flows into the cooling liquid flow channel 43, while the cooling liquid from the cooling liquid flow channel 43 does not flow out to the cooling liquid returning channel 56 due to the check valves 24 and 25. Therefore, positive pressure in the cooling liquid flow channel 43 is increased. Then, if an inertial force in a left direction of the running direction applied to the cooling liquid of the lead portion 58 of the cooling liquid returning channel 56 is eliminated, the cooling liquid in the cooling liquid flow channel 43 passes through the check valves 24 and 25 and flows out to the cooling liquid returning channel 56 due to the positive pressure in the cooling liquid flow channel. That is, the cooling liquid is circulated by using the inertial force applied to the cooling force due to the reciprocation of the head unit 4, without using an electric-powered pump.

According to the above configuration, the flexible film 30 is three-dimensionally formed by the swollen portions 30*b* to 30*i*. Therefore, the possible amount of deformation is increased, as compared with a known planar damper wall. Therefore, even if the damper area in plan view is small, a large pressure change absorption effect is obtained. As a result, compactness of the ink jet printer 1 can be achieved and the change in pressure can be sufficiently absorbed. In addition, the swollen portions 30*b* to 30*i* are swollen in the gravity direction, and ink is accumulated in the damper chambers 40 and 41 in the swollen portion 30*b* to 30*i* due to a self-weight. Therefore, it is possible to prevent the swollen portions 30*b* to 30*i* from shriveling and being flattened.

The flexible film 30 is hot formed by using a matched molding method and the flexible film 30 is formed to have a uniform thickness all over. Therefore, it is possible to suppress a variation in the pressure change absorption effect due to a difference in film rigidity between products or a local difference in rigidity in the same film. In addition, since the flexible film 30 is bonded to the base member 22 by thermal welding, sealability of the damper chambers 40 and 41 between the base member 22 and the flexible film 30 is improved. Furthermore, since the flexible film 30 is a single-layered film, even if the swollen portions 30*b* to 30*i* are formed deep, the film thickness can be maintained uniformly.

The swollen portions 30*b* to 30*i* have the main surfaces 30*j*, 30*k*, 30*q*, and 30*r*, and the sub surfaces 30*m*, 30*n*, 30*s*, 30*t*, 30*p*, and 30*u*. And, the main surfaces 30*j*, 30*k*, 30*q*, and 30*r* having a large area are flexed and accordingly a large change in volume occurs in the concave spaces 40 and 41. Therefore, even if the area of each of the swollen portions 30*b* to 30*i* in plan view is small, a large pressure change absorption effect can be obtained. In addition, with the cornice effect of the dent portions 30*v* and 30*w* and the crest portion 30*u* in the a sub surfaces 30*s*, 30*t*, and 30*u* of the swollen portions 30*b* to 30*i*, the main surfaces 30*q* and 30*r* are largely movable in the normal direction. Therefore, even if the area of the swollen portion 30*d* is small, a larger pressure change absorption effect can be obtained.

The base member 22 has the air-liquid separation films 27 and 29 at the upward positions opposed to the openings 30*x* and 30*y* of the swollen portions 30*b* to 30*i*. Therefore, even if air bubbles flows into the damper chambers 40 and 41, the air bubbles are separated from ink and trapped by the air-liquid separation films 27 and 29. As a result, it is possible to prevent air bubbles from reaching the ink jet head 33.

A plurality of damper chambers 40 and 41 are disposed in one flow channel of the ink supply flow channel 60. Therefore, a change in pressure of ink of different colors is sequentially absorbed by the plurality of damper chambers 40 and 41 from the upstream side to the downstream side over time. As a result, the change in pressure can be effectively and reliably absorbed.

The base member 22 has the protrusions 22*p* and 22*q* to protrude damper chamber 40 of each of the large swollen portions 30*b* to 30*e*. Therefore, even if the flexible large swollen portions 30*b* to 30*e* are unexpectedly to be collapsed, the swollen portions 30*b* to 30*e* are supported by the protrusions 22*p* and 22*q*. Therefore, it is possible to prevent the flexible member 30 from being bonded to the base member 22 with the swollen portions 30*b* to 30*e* crushed when manufacturing. In addition, the protrusions 22*p* and 22*q* are disposed so as not to be in contact with the large swollen portions 30*b* to 30*e* in a state where the large swollen portions 30*b* to 30*e* are at atmospheric pressure. Therefore, the protrusions 22*p* and 22*q* are usually not in contact with the large swollen portions 30*b* to 30*e*, and as a result, it is possible to prevent the flexible member 30 from being damaged when manufacturing.

The base member 22 has the inlet port 22*m* and the outlet port 22*n* at the positions opposed to the large swollen portions 30*b* to 30*e*, and the protrusions 22*p* and 22*q* are disposed between the inlet port 22*m* and the outlet port 22*n*. With this configuration, the protrusions 22*p* and 22*q* block the flow of ink from the inlet port 22*m* to the outlet port 22*n*. Therefore, a change in pressure of ink can be sufficiently absorbed by the damper chamber 40 over time. In addition, the inlet ports 22*m* and 22*t* are disposed in one end portions of the openings 30*x* and 30*y* of the swollen portions 30*b* to 30*i* in the long-side direction. Therefore, as for high pressure immediately after ink is introduced from the inlet ports 22*m* and 22*t* to the damper chambers 40 and 41, a change in pressure can be rapidly absorbed by using the end-portion regions of the swollen portion 30*b* to 30*i* having a large reaction force against volume expansion. Furthermore, the outlet ports 22*n* and 22*u* are provided in the other end portions opposite to the inlet ports 22*m* and 22*t* in the long-side direction, and the distance between inlet ports 22*m* and 22*t* and the outlet ports 22*n* and 22*u* becomes long. As a result, ink can flow out from the outlet ports 22*n* and 22*u* after the change in pressure is sufficiently absorbed.

In this exemplary embodiment, the ink supply flow channel 60 is an ink supply flow channel that constantly communicates the ink cartridge 8 and the ink jet head 33 with each other, but this is not intended to limit the invention. For example, the ink supply flow channel 60 may be an ink supply flow channel 60 that, as occasion demands, communicates the ink cartridge 8 and the ink jet head 33 with each other. In this case, preferably, communication and non-communication are made between the damper chambers 40 and 41 and the ink cartridge 8, and the damper chambers 40 and 41 and the ink jet head 33 constantly communicate with each other. Although in the exemplary embodiment the present invention is applied to the ink jet printer, the present invention may be applied to a liquid discharging apparatus that ejects a liquid other than ink, for example, an apparatus that ejects a coloring liquid to manufacture color filters for a liquid crystal display, or an apparatus that ejects a conductive liquid to form electric wires. Further, although in the exemplary embodiment the present invention is applied to the ink jet printer that has the ink jet head 4 as shown in FIG. 1, the present invention may be applied to a liquid discharging apparatus that has a line type inkjet head.

As described above, the liquid discharging apparatus according to the present invention has an excellent effect in achieving apparatus compactness and sufficiently absorbing a change in pressure. Advantageously, the present invention can be widely applied to an ink jet printer that is capable of exerting the significance of this effect.

According to an aspect of the present invention, a liquid discharging apparatus includes: a liquid discharging head that ejects liquid droplets onto a recording medium, a liquid from a liquid supply source being supplied to the liquid discharging head through a liquid supply flow channel. A damper chamber is provided in the liquid supply flow channel to relieve pressure of a liquid in the flow channel. The damper chamber is an internal space that is formed by bonding a flexible member to a base member, and the flexible member has a bonding surface that is bonded to the base member, openings that are formed in the bonding surface, and swollen portions that are three-dimensionally swollen from the edges of the openings to form the damper chamber. The base member has a communicating port, through which the damper chamber and the liquid supply flow channel communicate with each other in a state where the base member is bonded to the bonding surface of the flexible member and closes the openings. The flexible member is disposed such that the swollen portions are swollen in a gravity direction.

With this configuration, since the flexible member is three-dimensionally formed to have the swollen portions, the possible amount of deformation is increased, as compared with a known planar damper wall. Therefore, even if the damper area in plan view is small, a large pressure change absorption effect is obtained. As a result, apparatus compactness can be achieved and the change in pressure can be sufficiently absorbed. In addition, the swollen portions are swollen toward the gravity direction, and the liquid is accumulated in the concave space of each of the swollen portion due to a self-weight. Therefore, it is possible to prevent the swollen portions from shriveling and being flattened.

The liquid supply flow channel according to the invention is not limited to a liquid supply flow channel that constantly communicates the liquid supply source and the liquid discharging head with each other, but it may include a liquid supply flow channel that, as occasion demands, communicates the liquid supply source and the liquid discharging head with each other.

The flexible member may be made of a thin film-shaped flexible film, and the flexible film may be hot formed by using a matched molding method and bonded to the base member by thermal welding.

With this configuration, the flexible film is formed to have a uniform thickness all over. Therefore, it is possible to suppress a variation in the pressure change absorption effect due to a difference in film rigidity between products or a local difference in rigidity in the same film. In addition, since the flexible film is bonded by thermal welding, sealability of the damper chamber between the base member and the flexible film is improved.

The flexible film may be single-layered.

With this configuration, the flexible film is a single-layered film. Therefore, even if the swollen portions are formed deep, the film thickness can be maintained uniformly.

Each of the swollen portions may have a pair of main surfaces that protrude from the edge of a corresponding opening opposed to the base member in a direction away from the base member and are opposed to each other, and a sub surface that connects the pair of main surfaces with each other and has a smaller area than those of the main surfaces.

With this configuration, the main surfaces having a large area are flexed and accordingly a large change in volume occurs in the concave portions of the swollen portions. Therefore, even if the area of each of the swollen portions in plan view is small, a large pressure change absorption effect can be obtained.

The sub surface may have a crest portion or a dent portion whose section perpendicular to the main surfaces has a crest shape or a dent shape.

With this configuration, with a cornice effect of the crest portion or the dent portion in the sub surface, the main surfaces are largely movable in the normal direction. Therefore, even if the area of the swollen portion is small, a larger pressure change absorption effect can be obtained.

The base member may have air-liquid separation films that are provided at positions opposed to the openings of the swollen portions.

With this configuration, when air bubbles flows into the damper chamber from the upstream side, the air bubbles are separated from the liquid and trapped by the air-liquid separation films opposed to the openings of the swollen portions. Therefore, it is possible to prevent air bubbles from reaching the liquid discharging head.

A plurality of damper chambers may be disposed in one flow channel of the liquid supply flow channel.

With this configuration, as for the liquid flowing in one liquid supply flow channel, a change in pressure is sequentially absorbed by the plurality of damper chambers from the upstream side to the downstream side. Therefore, the change in pressure can be effectively and reliably absorbed.

The base member may have protrusions that are formed to protrude toward the damper chamber in the swollen portions.

With this configuration, even if the flexible swollen portions are unexpectedly to be collapsed, the swollen portions are supported by the protrusions. Therefore, it is possible to prevent the flexible member from being bonded to the base member with the swollen portions crushed when manufacturing.

The protrusions may be disposed so as not to be in contact with the swollen portions in a state where the swollen portions are at atmospheric pressure.

With this configuration, the protrusions are usually not in contact with the swollen portions. Therefore, it is possible to prevent the flexible member from being damaged when manufacturing.

The base member may have an inlet port and an outlet port as the communicating port that are formed at positions opposed to the swollen portion, and the protrusions may be disposed between the inlet port and the outlet port.

With this configuration, the protrusions block the flow of the liquid from the inlet port to the outlet port. Therefore, the change in pressure of the liquid can be sufficiently absorbed by the damper chamber in the swollen portion over time.

Each of the openings may be shaped to have a long side and a short side in plan view, the inlet port may be disposed at a position corresponding to one end portion in a long-side direction of the opening, and the outlet port may be disposed at a position corresponding to the other end portion in the long-side direction of the opening.

With this configuration, the inlet port is disposed in one end portion of the opening of each of the swollen portions. Therefore, as for high pressure immediately after the liquid is introduced from the inlet port to the damper chamber of the swollen portion, a change in pressure can be rapidly absorbed by using the end-portion region of the swollen portion having a large reaction force against volume expansion. In addition, the outlet port is provided in the other end portion opposite to the inlet port in the long-side direction, and thus a distance between the inlet port and the outlet port becomes long. As a result, the liquid can flow out from the outlet port after the change in pressure is sufficiently absorbed.

The liquid supply flow channel may have a flow channel that is formed by a liquid supply tube connected to the liquid supply source, and a flow channel that is formed by the base member connected to the liquid supply tube.

With this configuration, even if a change in pressure is transmitted from the liquid supply source or the liquid supply tube, the change in pressure can be sufficiently absorbed by the damper chamber.

The liquid discharging head and the damper chamber may be disposed on a carriage reciprocating with respect to the recording medium.

With this configuration, even if a change in pressure occurs in the liquid supply flow channel due to an inertial force caused by the reciprocation of the carriage, the change in pressure can be sufficiently absorbed by the damper chamber. In addition, it is possible to prevent the change in pressure from being transmitted to the liquid discharging head.

As will be apparent from the above description, according to the invention, the flexible member is three-dimensionally formed to have the swollen portions. Therefore, apparatus compactness can be achieved and a change in pressure can be sufficiently absorbed. In addition, the swollen portions are swollen in the gravity direction, and the liquid is accumulated in the concave space of each of the swollen portions from shriveling and being flattened.

What is claimed is:

1. A liquid discharging apparatus comprising:

a liquid discharging head that discharges a liquid onto a recording medium, the liquid, which is supplied from a liquid supply source, being supplied to the liquid discharging head through a liquid supply flow channel; and a damper chamber that is provided in the liquid supply flow channel to relieve pressure of the liquid in the liquid supply flow channel, the damper chamber being an internal space that is formed by bonding a flexible member to a base member, wherein the flexible member has a bonding surface that is bonded to the base member, an opening that is formed in the bonding surface, and a swollen portion that is three-dimensionally swollen from the edge of the opening to form the damper chamber, the base member has a communicating port, through which the damper chamber and the liquid supply flow channel communicate with each other, in a state where the base member is bonded to the bonding surface of the flexible member and closes the opening, and the flexible member is disposed such that the swollen portion is swollen in a direction away from the base member.

2. The liquid discharging apparatus according to claim 1, wherein the flexible member is made of a thin film-shaped flexible film, and the flexible film is hot formed by using a matched molding method and bonded to the base member by thermal welding.

3. The liquid discharging apparatus according to claim 2, wherein the flexible film is single-layered.

4. The liquid discharging apparatus according to claim 1, wherein the swollen portion have a pair of main surfaces that protrude from the edge the opening opposed to the base member in a direction away from the base member and are opposed to each other, and a sub surface that connects the pair of main surfaces with each other and has a smaller area than that of the pair of main surfaces.

5. The liquid discharging apparatus according to claim 4, wherein the sub surface has at least one of a crest portion whose section perpendicular to the pair of main surfaces has a crest shape and a dent portion whose section perpendicular to the pair of main surfaces has a dent shape.

6. The liquid discharging apparatus according to claim 1, wherein the base member has an air-liquid separation film that is provided at a position opposed to the opening of the swollen portion.

7. The liquid discharging apparatus according to claim 1, wherein a plurality of the damper chambers are disposed in one flow channel of the liquid supply flow channel.

8. The liquid discharging apparatus according to claim 1, wherein the base member has a protrusion that is formed to protrude toward the damper chamber in the swollen portion.

9. The liquid discharging apparatus according to claim 8, wherein the protrusion is disposed so as not to be in contact with the swollen portion in a state where the swollen portion is at atmospheric pressure.

10. The liquid discharging apparatus according to claim 8, wherein the base member has an inlet port and an outlet port as the communicating port which are formed at positions opposed to the swollen portion, and the protrusion is disposed between the inlet port and the outlet port.

11. The liquid discharging apparatus according to claim 10, wherein the opening is shaped to have a long side and a short side in plan view, the inlet port is disposed at a position corresponding to a first end portion in a long-side direction of the opening, and the outlet port is disposed at a position corresponding to a second end portion opposite to the first end portion in the long-side direction of the opening.

12. The liquid discharging apparatus according to claim 1, wherein the liquid supply flow channel has a flow channel that is formed by a liquid supply tube connected to the liquid supply source, and a flow channel that is formed by the base member connected to the liquid supply tube.

13. The liquid discharging apparatus according to claim 1, wherein the liquid discharging head and the damper chamber are disposed on a carriage that reciprocates with respect to the recording medium.

14. The liquid discharging apparatus according to claim 1, wherein the flexible member is disposed between the base member and the liquid discharging head.

* * * * *